United States Patent [19]

Scherubel

[11] 4,235,734

[45] Nov. 25, 1980

[54] FOAMED ACIDS STABILIZED WITH ALKANOLS

[75] Inventor: Gary A. Scherubel, Tulsa, Okla.

[73] Assignee: The Dow Chemical Company, Midland, Mich.

[21] Appl. No.: 964,868

[22] Filed: Nov. 30, 1978

[51] Int. Cl.[2] ..... C11D 7/08; C11D 7/32; C11D 7/26

[52] U.S. Cl. ..... 252/142; 252/8.55 R; 252/8.55 C; 252/307

[58] Field of Search ..... 252/142, 307, 8.55 R, 252/8.55 C; 134/3, 41; 166/307

[56] References Cited

U.S. PATENT DOCUMENTS

| | | | |
|---|---|---|---|
| 3,037,887 | 6/1962 | Brenner et al. | 134/22 |
| 3,394,768 | 7/1968 | Chocola et al. | 252/307 X |
| 3,422,011 | 1/1969 | Jackovitz et al. | 252/307 X |
| 3,436,262 | 4/1969 | Crowe et al. | 134/10 |
| 3,511,784 | 5/1970 | Riggs et al. | 134/3 X |
| 3,518,118 | 6/1970 | Farison | 134/3 X |
| 3,548,945 | 12/1970 | Gidley | 166/307 |
| 3,579,446 | 5/1971 | Kroke et al. | 252/307 X |
| 3,639,283 | 2/1972 | Crotty | 252/142 X |
| 3,819,520 | 6/1974 | Jones et al. | 166/307 X |
| 3,917,536 | 11/1975 | Crowe | 252/8.55 C |
| 3,937,283 | 2/1976 | Blauer et al. | 166/307 |
| 3,954,636 | 5/1976 | Crowe et al. | 252/8.55 C |

*Primary Examiner*—Harris A. Pitlick
*Attorney, Agent, or Firm*—L. L. White

[57] ABSTRACT

A liquid, foamable acid composition is described which comprises a liquid foaming agent (i.e., a surfactant) and an alkanol or an inertly-substituted alkanol dissolved in an aqueous acid. The foamed compositions find utility, for example, in cleaning ferrous surfaces.

14 Claims, No Drawings

FOAMED ACIDS STABILIZED WITH ALKANOLS

BACKGROUND OF THE INVENTION

This invention pertains to novel liquid, foamable acid compositions and to foams prepared from said compositions. This invention also pertains to the use of said foams in cleaning ferrous surfaces and fracturing subterranean formations.

Foams of aqueous acids have been described previously. These acid foams have been used, for example, to clean ferrous surfaces and in fracturing subterranean formations. The acid foams are prepared by frothing a liquid acid comprising a foaming agent (i.e., a surfactant). The foam itself has been typically generated by mechanical means (e.g., mechanical stirrers), by chemical means (e.g., a blowing agent) or by physical means (e.g., bubbling a gas through the liquid). The state of the art is illustrated, for example, by Brenner et al. (U.S. Pat. No. 3,037,887), Crowe et al. (U.S. Pat No. 3,436,262), and Blauer et al. (U.S. Pat. No. 3,937,283). The disclosures of these patents are incorporated herein by reference.

Brenner et al. describe foamable acid compositions, the use of acid foams in cleaning of ferrous surfaces and also describe mechanical methods of generating the foam. The liquid, foamable acid compositions described by Brenner et al. comprised an acid solution containing a foaming or frothing-producing aid. These foaming or frothing aids are substances known to the industry as surfactants which, by decreasing the surface tension of the liquid, render the liquid more readily foamable and produce a more stable foam. These surfactants are cationic, anionic, or nonionic in nature. The foams were produced by blowing a gas through the liquid.

Crowe et al. describe acid foams which are similarly useful in cleaning ferrous surfaces. The liquid, foamable acid compositions described by Crowe et al. were acid solutions comprising a surfactant and a "blowing agent" which was liquid or solid as incorporated into the composition but became a gas at an elevated temperature. The foam was thus produced by heating the composition to the point at which the blowing agent became gaseous.

Blauer et al. described a stable acid foam which was used to fracture subterranean formations. The liquid, foamable composition likewise comprised a surfactant dissolved in the liquid acid (or base), a propping agent (e.g., sand) and a gas.

In each of these utilities, it is desirable that the foam height and stability be increased as much as possible to maximize performance.

SUMMARY OF THE INVENTION

Novel liquid, foamable acid compositions have now been discovered which yield increased foam height and/or stability. The novel compositions comprise (a) at least one foaming agent and (b) at least one alkanol or inertly-substituted alkanol dissolved in (c) an aqueous acid.

The novel compositions differ from the prior art (cited above) essentially in the inclusion of a foam-enhancing amount of an alkanol or inertly-substituted alkanol. The discovery that such alkanols would enhance foam height and/or stability of acid foams was unexpected.

DETAILED DESCRIPTION OF THE INVENTION

The alkanols or inertly-substited alkanols used in the present invention are a known class of compounds having a hydroxyl group(s) attached to an aliphatic carbon atom in the molecule. Essentially any member of this group may be used in the instant invention so long as the compound is soluble in the aqueous acid medium and compatible with the particular foaming agent chosen. No undue experimentation is required to determine these factors and a simple test will be hereafter provided for evaluation. Examples of the alkanol or inertly-substituted alkanols which can be used herein include, for example, lower alkanols (e.g., methanol, ethanol, isopropanol, n-butanol, etc.), 1,2-alkylene glycols (e.g., ethylene glycol, propylene glycol, etc.), polyoxyalkylene glycols and monoethers thereof (e.g., diethylene glycol, triethylene glycol, and other oligomers on up to and including polyoxyethylene glycol of molecular weights of about 10000 or more, dipropylene glycol, tripropylene glycol, and other oligomers on up to and including polyoxypropylene glycol of molecular weight about 400 and above, copolymers of ethylene oxide and propylene oxide, copolymers of ethylene oxide and 1,2-butylene oxide, and the like, and the corresponding monoethers thereof having an alkyl (e.g., methyl, ethyl, t-butyl, n-octyl, dodecyl, etc.), phenyl (e.g., phenyl, tolyl, chlorophenyl, p-t-butylphenyl, p-i-butylphenyl, nonylphenyl, etc.) or other hydrocarbyl or inertly-substituted hydrocarbyl cap, and the like. These monoethers include, for example, propylene glycol methyl ether, dipropylene glycol methyl ether, tripropylene glycol methyl ether, propylene glycol isobutyl ether and higher homologs having additional oxypropylene groups, ethylene glycol methyl ether, ethylene glycol ethyl ether, ethylene glycol n-butyl ether, diethylene glycol methyl ether, diethylene glycol n-butyl ether, ethylene glycol phenyl ether, ethoxylated n-nonylphenol having approximately 10 moles of ethylene oxide condensed onto one mole of nonylphenol, etc. Presently preferred alkanols or inertly-substituted alkanols are the monoethers in which from one to four moles of ethylene oxide are condensed onto an alkanol of from one to four carbon atoms or phenol, a polyoxyethylene glycol having an average molecular weight of from about 200 to about 2000 or a polyoxypropylene glycol having an average molecular weight of up to about 500. Of these, the ethylene glycol n-butyl ether and polyoxypropylene glycol of average molecular weight about 350–400 are most preferred.

The alkanols or inertly-substituted alkanols are included in the novel compositions in a froth-enhancing amount. Typically, these compounds are included in an amount of from about 0.25 to about 7 volume percent, based on total volume of the composition.

The acids and surfactants used in the instant invention have been described in the Brenner et al., Crowe et al., and Blauer et al., patents which are incorporated herewith by reference. An exhaustive listing of such components is therefore not required in this application. It is sufficient to say that both inorganic acids and organic acids are suitable for use herein and that the preferred acid is hydrochloric acid. Likewise, the present invention can also utilize foaming agents (i.e., surfactants) that are cationic, or nonionic. The cationic surfactants (e.g., quaternary ammonium compounds, quaternary phosphonium compounds, acid/amine salts of tertiary amines, etc.) are normally very compatible with the acid systems and thus preferred. The surfactants are included in the novel compositions in amounts to give the desired degree of foaming. Typically this means that the foaming agents will be added in an amount of from about 0.25 up to about 5 weight percent.

Typical methods of foaming the novel compositions are described in the Brenner et al., Crowe et al., and Blauer et al. patents referred to above. Likewise, these patents fully describe the methods by which these foamed acid compositions are used in cleaning ferrous surfaces and in fracturing subterranean formations. The patents also show that other additives may be advantageously included in the acid compositions (e.g., corrosion inhibitors, propping agents, etc.).

Experimental

The following experiments will further illustrate the invention. All "parts" are parts by weight unless specified otherwise.

The foaming tests were conducted by adding 100 milliliters (ml) of the acid containing 1 percent by volume surfactant into a Waring Blendor and mixing at the highest rate of shear for 30 seconds. The foam is then poured from the Blendor into a graduated cylinder and the volumes of the foam and liquid drainage measured as a function of time. The initial foam height is recorded in milliliters. The half life of the foam is recorded in minutes and is measured by the time required for 50 milliliters of liquid to break away and drain from the foam.

Experiments 1–5:

In these experiments, the foam was tested as indicated above using 15 percent hydrochloric acid and 1 percent of a commercial cationic surfactant which is, essentially, 3 parts of a cocotrimethyl ammonium chloride and 1 part of a bis(2-hydroxyethyl) cocoamine oxide. This surfactant will be hereafter referred to as Surfactant I. The results of these experiments are presented in Table A.

TABLE A

| Run | Alkanol (%) | | Foam Height (ml) | Half-Life (minutes) |
|---|---|---|---|---|
| 1 | — | | 490 | 4.5 |
| 2 | Dowanol EB* | (1.0) | 590 | 4.2 |
| 3 | Dowanol EB | (2.0) | 770 | 4.5 |
| 4 | P-400** | (1.0) | 630 | 4.4 |
| 5 | P-400 | (2.0) | 700 | 4.8 |

*Dowanol EB is ethylene glycol monobutyl ether.
**P-400 is a polypropylene glycol having an average molecular weight of approximately 400.

Both products are commercially available from The Dow Chemical Company.

Experiments 6–9:

In a similar series of experiments, the acid used was 15 percent hydrochloric acid containing 0.4 volume percent of a commercial corrosion inhibitor (marketed by The Dow Chemical Company under the designation A-200) and 1.0 volume percent of ethylene glycol monobutyl ether. To this base composition was added various amounts of Surfactant I and the materials foamed. The results are summarized in Table B below:

TABLE B

| Run | Surfactant I (%) | Foam Height (ml) | Half-Life (minutes) |
|---|---|---|---|
| 6 | — | No Foam | — |
| 7 | 0.25 | 260 | 1.2 |

TABLE B-continued

| Run | Surfactant I (%) | Foam Height (ml) | Half-Life (minutes) |
|---|---|---|---|
| 8 | 0.50 | 390 | 2.9 |
| 9 | 1.0 | 500 | 4.6 |

Experiments 10–17:

In a similar series of tests, 15 percent hydrochloric acid containing 0.4 volume percent of the corrosion inhibitor A-200 and 1.0 volume percent of Surfactant I was blended with various amounts of ethylene glycol monobutyl ether and foamed. The results are summarized in Table C below:

TABLE C

| Run | Dowanol EB (%) | Foam Height (ml) | Half-Life (minutes) |
|---|---|---|---|
| 10 | — | 400 | 3.5 |
| 11 | 0.25 | 450 | 4.5 |
| 12 | 0.50 | 460 | 4.6 |
| 13 | 1.0 | 500 | 4.4 |
| 14 | 4.0 | 545 | 3.8 |
| 15 | 5.0 | 600 | 3.7 |
| 16 | 7.0 | 490 | 3.5 |
| 17 | 10.0 | 410 | 3.1 |

Experiments 18–27:

In this series of experiments, aliquots of a 10 percent hydrochloric acid solution containing 0.2 volume percent of a corrosion inhibitor (marketed by The Dow Chemical Company under the name A-120) and 1.0 volume percent of Surfactant I were blended with various amounts of either ethylene glycol monobutyl ether or the polypropylene glycol P-400. The results are summarized in Table D below:

TABLE D

| Run | Alkanol (%) | Foam Height (ml) | Half-Life (minutes) |
|---|---|---|---|
| 18 | — | 480 | 4.8 |
| 19 | Dowanol EB | 710 | 4.5 |
| 20 | Dowanol EB | 760 | 4.6 |
| 21 | Dowanol EB | 750 | 4.0 |
| 22 | P-400 | 740 | 5.3 |
| 23 | P-400 | 750 | 5.4 |
| 24 | P-400 | 600 | 4.8 |
| 25 | Polyglycol 15-200* | 430 | 4.9 |
| 26 | Polyglycol 15-200 | 700 | 5.3 |
| 27 | Polyglycol 15-200 | 710 | 5.8 |

*Polyglycol 15-200 is a water-soluble polyproplene glycol which is marketed by The Dow Chemical Company. One of the markets for this compound is a defoamer.

Experiments 28–37:

In a similar series of experiments, aliquots of a 10 percent formic acid containing 0.1 volume percent of a corrosion inhibitor (marketed by The Dow Chemical Company under name A-196) and 1.0 volume percent of Surfactant I were blended with various quantities of ethylene glycol monobutyl ether and polypropylene glycol P-400. The results are summarized in Table E.

TABLE E

| Run | Alkanol (%) | | Foam Height (ml) | Half-Life (minutes) |
|---|---|---|---|---|
| 28 | — | | 580 | 3.5 |
| 29 | Dowanol EB | (1.0) | 760 | 3.9 |
| 30 | Dowanol EB | (2.0) | 630 | 3.5 |
| 31 | Dowanol EB | (5.0) | 420 | 3.3 |
| 32 | P-400 | (1.0) | 650 | 3.6 |
| 33 | P-400 | (2.0) | 630 | 3.5 |
| 34 | P-400 | (5.0) | 520 | 4.0 |
| 35 | Polyglycol 15-200 | (1.0) | 520 | 3.8 |

TABLE E-continued

| Run | Alkanol (%) | | Foam Height (ml) | Half-Life (minutes) |
|---|---|---|---|---|
| 36 | Polyglycol 15-200 | (2.0) | 560 | 3.9 |
| 37 | Polyglycol 15-200 | (5.0) | 470 | 4.8 |

These experiments indicate that increased foam height and/or stability can be obtained using the indicated alkanols but that the enhanced foam height and foam stability may be independent.

Experiments 38–45:

In a similar series of experiments, aliquots of a 15 percent sulfuric acid containing 0.2 weight percent of a corrosion inhibitor (marketed by The Dow Chemical Company under the designation A-196) and either 1.0 or 2.0 volume percent of a commercial surfactant called Aquet X-21 (marketed by Aquaness Chemical Company) and various amounts of polypropylene glycol P-400 or polyglycol 15-200. The results are summarized in Table F.

TABLE F

| Run | Alkanol (%) | | Foam Height (ml) | Half-Life (minutes) |
|---|---|---|---|---|
| 38 | — | | 360 | 6.0 |
| 39 | —* | | 450 | 7.5 |
| 40 | P-400 | (1.0) | 580 | 7.0 |
| 41 | P-400 | (2.0) | 530 | 7.2 |
| 42 | P-400 | (5.0) | 510 | 6.9 |
| 43 | Polyglycol 15-200 | (1.0) | 580 | 7.4 |
| 44 | Polyglycol 15-200 | (2.0) | 570 | 7.5 |
| 45 | Polyglycol 15-200 | (5.0) | 560 | 9.3 |

*Includes two parts of surfactant instead of one.

Utility

The compositions described in the above examples are each useful in cleaning ferrous surfaces by the methods described by Brenner et al. For example, foams prepared using 10 percent hydrochloric acid and 1 volume percent Surfactant I and approximately 1 percent of ethylene glycol monobutyl ether or polypropylene glycol P-400 and minor amounts of commercial corrosion inhibitors as illustrated above gave excellent cleaning results in cleaning condenser tubing on commercial size apparatus.

What is claimed is:

1. A foam derived from a foamable acid composition comprising (a) a foam-generating amount of at least one soluble cationic surfactant, (b) a foam-stabilizing amount of at least one alkanol or inertly-substituted alkanol, dissolved in (c) an aqueous acid.

2. The composition defined by claim 1 wherein (b) is a lower alkanol, a 1,2-alkylene glycol, a polyoxyalkylene glycol, a monoether of said 1,2-alkylene glycol or polyoxyalkylene glycol, or mixtures thereof.

3. The composition defined by claim 2 wherein (b) is an ethoxylated alkanol or phenol in which from 1 to 4 moles of ethylene oxide are condensed onto an alkanol of from 1 to 4 carbon atoms or phenol, a polyoxyethylene glycol having an average molecular weight of from 200 to about 2000, or a polyoxypropylene glycol having an average molecular weight of up to about 500.

4. The composition defined by claim 3 wherein (b) is ethylene glycol n-butyl ether or a polyoxypropylene glycol having an average molecular weight of from about 350 to about 450.

5. The composition defined by claim 4 wherein (b) is a polyoxypropylene glycol having an average molecular weight of from about 350 to about 450.

6. The composition defined by claim 1 wherein said acid is hydrochloric acid, sulfuric acid or formic acid.

7. The composition defined by claim 6 wherein said acid is hydrochloric acid.

8. The composition defined by claim 1 wherein (b) is ethylene glycol monobutyl ether or a polyoxypropylene glycol having an average molecular weight of from about 350 to about 450, and (c) is aqueous hydrochloric acid, sulfuric acid or formic acid.

9. The composition defined by claim 8 wherein (c) is hydrochloric acid.

10. The composition defined by claim 9 wherein (b) is a polyoxypropylene glycol having an average molecular weight of from about 350 to about 450.

11. In the process of cleaning acid-soluble encrustations from ferrous surfaces by contacting the encrusted surface with a foamed acid composition, the improvement comprising using the composition defined by claim 1 as the foamed acid composition.

12. A foam derived from a foamable acid composition consisting essentially of (a) from about 0.25 to about 5 weight percent of a cationic surfactant mixture of about 3 parts cocotrimethylammonium chloride and about one part bis(2-hydroxyethyl) cocoamine oxide, (b) from about 0.25 to about 7 volume percent of ethylene glycol monobutyl ether or a polyoxypropylene glycol having an average molecular weight of about 350 to 450, dissolved in (c) aqueous hydrochloric acid.

13. The composition defined by claim 12 additionally containing an acid corrosion inhibitor.

14. In the process of cleaning acid-soluble encrustations from ferrous surfaces by contacting the encrusted surface with a foamed acid composition, the improvement comprising using the composition defined by claim 13 as the foamed acid composition.

* * * * *